United States Patent [19]

Bellew

[11] 4,020,781

[45] May 3, 1977

[54] MARINE PROPULSION SYSTEMS WITH VARIABLE-PITCH SCREW PROPELLERS

[75] Inventor: Wilfred Thomas Bellew, Rochdale, England

[73] Assignee: Newage Engineers Limited, Stamford, England

[22] Filed: Apr. 22, 1975

[21] Appl. No.: 570,955

[30] Foreign Application Priority Data

Dec. 4, 1974 United Kingdom ..... 52444/74

[52] U.S. Cl. ..... 115/34 A; 416/157 B

[51] Int. Cl.[2] ..... B63H 3/08

[58] Field of Search ..... 115/34 R, 34 A; 416/157, 162

[56] References Cited

UNITED STATES PATENTS

| | | | |
|---|---|---|---|
| 2,255,920 | 9/1941 | Englesson | 416/157 |
| 2,304,153 | 12/1942 | Cesare | 416/157 |
| 2,456,361 | 12/1948 | Atteslander | 416/157 |
| 2,661,807 | 12/1953 | Fielding | 416/157 |
| 2,959,156 | 11/1960 | Dreptin | 416/157 |
| 3,148,735 | 9/1964 | Miller et al. | 416/157 |
| 3,711,221 | 1/1973 | Almqvist | 416/157 |

FOREIGN PATENTS OR APPLICATIONS

| | | | |
|---|---|---|---|
| 890,187 | 1/1972 | Canada | 416/157 |
| 1,310,839 | 3/1973 | United Kingdom | 416/157 |

*Primary Examiner*—Trygve M. Blix
*Assistant Examiner*—Stuart M. Goldstein
*Attorney, Agent, or Firm*—Cushman, Darby & Cushman

[57] ABSTRACT

Marine propulsion equipment for installation in a ship or boat comprises a screw propeller with variable-pitch blades, mounted on one end of a propeller shaft whose other end is coupled to the output flange of a reversible speed-reduction gearbox. A pitch control rod is connected at one end through a linkage to the blades and extends within an axial bore in the shaft, the rod being longitudinally movable by a hydraulic actuator between predetermined limiting positions corresponding respectively to a coarse-pitch setting and a fine-pitch setting of the screw blades. The actuator is of piston-and-cylinder type interposed between the output shaft of the gearbox and the adjacent end of the propeller shaft as a part of the drive train. The actuator cylinder is formed either in a half-coupling which connects the shaft to the gearbox output flange, or in a separate tubular capsule which is itself connected between the half-coupling and the gearbox output flange. The piston of the actuator is rigidly secured, directly or via an intermediate piston rod, to the end of the pitch control rod remote from the propeller. Pressurized hydraulic fluid is admitted through a longitudinal passage in the output shaft of the gearbox, under the control of, for example, a solenoid-operated valve, into the actuator cylinder to drive the piston and pitch control rod in the direction towards the propeller into a limiting position corresponding to a fine-pitch forward setting of the blade angle, against the force of return spring means. When the actuator is de-pressurized, the return spring means returns the piston and pitch control rod to a second limiting position corresponding to a coarse-pitch forward setting of the blade angle. The limiting positions are determined by stops at opposite ends of the cylinder against which the piston abuts.

58 Claims, 10 Drawing Figures

10
11
12
13
45
48
49
50
51
52
53
54
II

MARINE PROPULSION SYSTEMS WITH VARIABLE-PITCH SCREW PROPELLERS

BACKGROUND AND OBJECTS OF THE INVENTION

This invention relates to marine propulsion systems of the kind which includes a power-driven screw propeller having blades of adjustable pitch, the propeller being mounted on a propeller shaft driven by an engine or other prime mover in a vessel.

An object of the present invention is to provide an improved marine propulsion system of the aforesaid kind which is simple and economical to manufacture, and which enables conventional components, and existing standard parts, components and assemblies to be utilised in a novel manner in its manufacture.

Another object of the invention is to provide a marine propulsion system of the aforesaid kind having a two-position setting of the blade pitch angle and a simple mechanical system for selectively effecting the pitch setting.

In known systems of the kind referred to, hydraulic or mechanical pitch control means is provided which can be operated to adjust the blade pitch angle into any setting in an infinitely-variable range extending from full-ahead pitch to full-astern pitch. The propeller shaft drive is usually transmitted from the prime mover to the shaft through a speed-reduction gearbox, which may not provide a reverse drive, and to effect reverse propulsion the blades are adjusted into a reverse-pitch angle setting.

Another object of the invention is to provide a marine propulsion system of the aforesaid kind having a two-position setting of the blade pitch angle, which settings respectively correspond to coarse-pitch and fine-pitch blade angles, in conjunction with a reversible reduction gearbox which enables either forward or reverse propulsion of the associated vessel to be effected with the blades in either setting.

A yet further object of the invention is to provide a simple pressure-fluid-operated actuator which can be incorporated between the reduction gearing and the propeller shaft in a marine propulsion unit of the kind aforesaid and by which the selective adjustment of the blade pitch into either of two predetermined settings can be effected.

BRIEF SUMMARY OF THE INVENTION

According to the present invention, marine propulsion apparatus comprises a screw propeller with adjustable-pitch blades, a pitch control member operatively coupled to the propeller for adjusting the pitch of the blades, biasing means acting on the pitch control member to bias the said member towards a first setting corresponding to a predetermined forward pitch angle, and a power-operated actuator coupled to the pitch control member and arranged when operated to move the pitch control member into a second setting corresponding to a different predetermined pitch angle against the action of the biasing means, the actuator when de-energised permitting the pitch control member to be moved by the biasing means into its said first setting.

The actuator preferably comprises a hydraulic piston and cylinder.

In one form of the invention, the said first setting of the pitch control member corresponds to a first pitch angle suitable for normal free forward running of the vessel, and the said second setting corresponds to a lesser pitch angle than the first, for example a reduced forward pitch angle suitable for towing or trawling or some other condition of increased forward propulsive thrust. With such an arrangement, according to a further feature of the invention, a reduction gearbox with a reverse gear is preferably utilised to transmit the driving torque of the prime mover to the propeller shaft. Thus reverse drive of the vessel (with choice of either of the predetermined coarse-pitch and fine-pitch blade angle settings) can be provided by selection of reverse gear in the gearbox, instead of by reversal of the pitch of the propeller as in conventional systems. This enables a standard reverse reduction gearbox to be utilised in conjunction with a two-position pitch control system embodying the invention, instead of the much more expensive conventional arrangement of a double-acting hydraulic pitch control system providing infinite pitch variation between full forward pitch and full reverse pitch, in conjunction with a non-reversing reduction gearbox.

Where the pitch control actuator of the invention is a hydraulic actuator, it may conveniently be energised by pressurised oil from an oil pump associated with the transmission gearbox, for example the pump which feeds the gearbox pressurised lubrication system, the additional oil required by the pitch control actuator either being accommodated in the gearbox itself, or in a separate additional reservoir connected to the gearbox sump. Preferably, however, a separate pump should be provided, in association with a separate and additional oil reservoir.

It will be appreciated that with a pitch control system according to the invention in which the actuator is only pressurised in order to adjust the blades to their fine-pitch setting, for trawling or towing conditions, the blades will always be automatically returned to their coarse-pitch setting when the actuator is not pressurised. Hence even in event of a failure of the hydraulic actuator or of its oil pump or oil supply, the system will still enable the vessel to be driven with the blades in their coarse-pitch settings, as if with a solid-pitch propeller, for normal free-running operation. Hence a malfunction of the actuator or of its hydraulic supply will not impair the capability of the vessel to operate as if with a normal fixed-pitch free-running installation.

Conveniently, the actuator may be mounted between the output flange of the gearbox and the inboard end of the propeller shaft, and may be supplied with pressure oil through a coaxial passage in the output shaft of the gearbox. In such an arrangement the actuator piston would be mounted on the end of a longitudinally-movable pitch control rod extending through a central bore of the propeller shaft to a cam block and trunnion pitch adjustment mechanism in the hub of the propeller.

The pressure oil supply for the actuator is preferably independent of the gearbox lubrication system, e.g. from a separate oil pump fed from a separate reservoir. Thus an additional pump, electrically or mechanically driven from an external source, or mounted in tandem with the gearbox lubrication pump so as to be driven by the same drive shaft as the latter, may be provided to supply the pressure fluid for the pitch control actuator, preferably through the longitudinal passage in the output shaft of the gearbox. Another possibility is to add a second set of pumping vanes or pinions, and a second pump chamber, to the structure of the gearbox lubrication system pump, providing in effect a parallel pump stage driven through one pump spindle.

The supply of pressurised fluid to the actuator may be controlled by a solenoid-operated valve, itself operated by remote control, or by any other suitable remote-controlled valve or equivalent means, for example by remote control of the energisation of the oil pump which supplies the actuator.

The spring system which biases the pitch control member towards its first setting preferably comprises one or more springs of disc or diaphragm type, which provide a very short compression stroke for a given high value of compressive stress, thereby reducing the required axial length of the actuator. However a helical compression spring, or a cluster of helical compression springs, could be used as the biasing means.

A yet further object of the invention is to provide, for use in the marine propulsion system referred to, a hydraulic actuator of piston-and-cylinder type having a tubular sleeve constructed and arranged to be rigidly secured at one end to the output shaft flange of a reduction gearbox and at the other end to a propeller shaft, the piston of the actuator having means for securing it to one end of a pitch control rod extending within the propeller shaft, the cylinder of the actuator being formed within the sleeve.

A yet further object of the invention is to provide, for use in the marine propulsion system referred to, a speed-reduction gearbox having an output shaft with an output flange, in combination with a hydraulic actuator of piston-and-cylinder type whose cylinder is formed in a tubular member rigidly secured coaxially at one end to the said output flange, the opposite end of said tubular member being adapted to be secured coaxially to a propeller shaft, and the piston of the actuator being adapted to be rigidly secured to one end of a longitudinally-movable pitch control rod extending within the propeller shaft.

Further objects and advantages of the invention will be apparent from the following detailed description and from the accompanying drawings.

The invention may be carried into practice in various ways, but two specific embodiments will now be described by way of example only and with reference to the accompanying drawings, in which.

Figure 1:
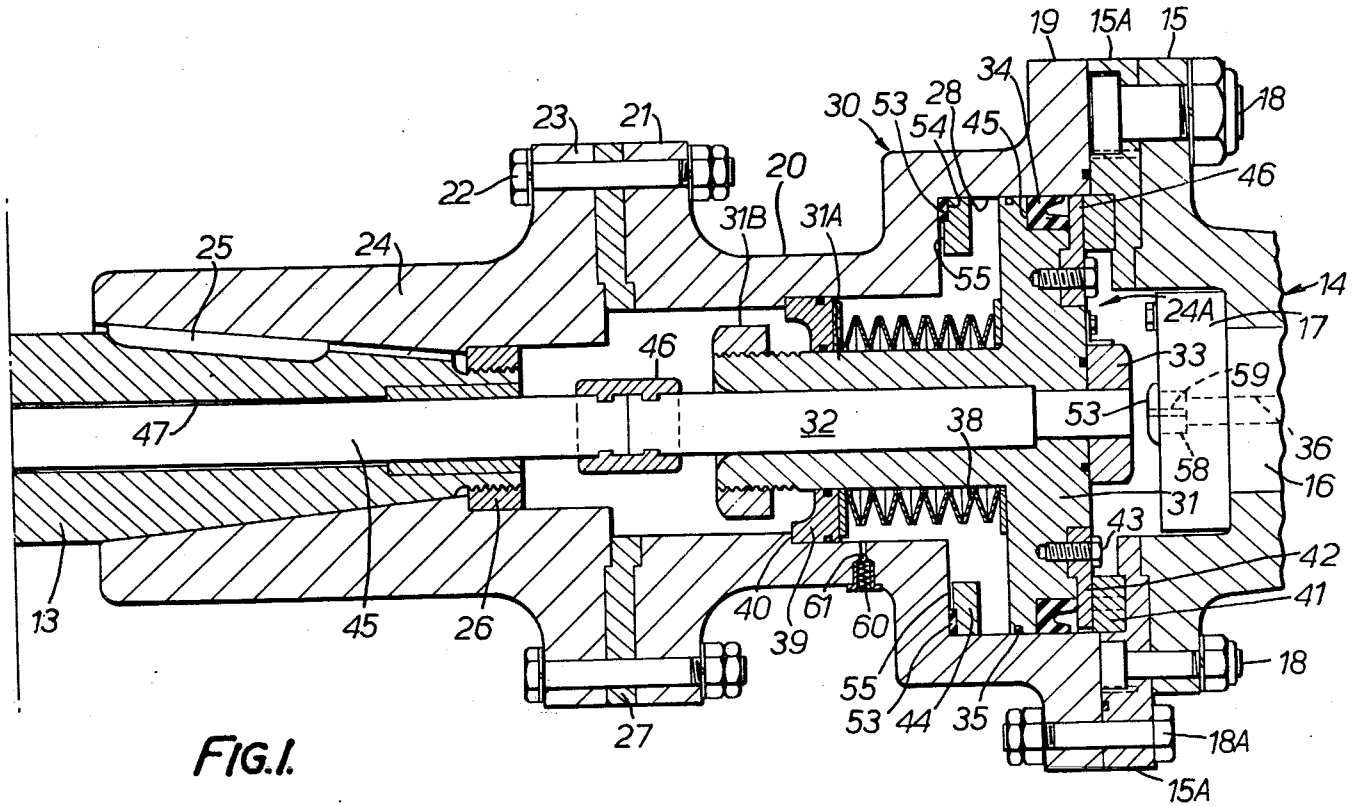
FIG. 1 (on two sheets) is a longitudinal sectional view of the propeller shaft and part of the reduction gearbox of a ship's screw propulsion system.
Figure 3:
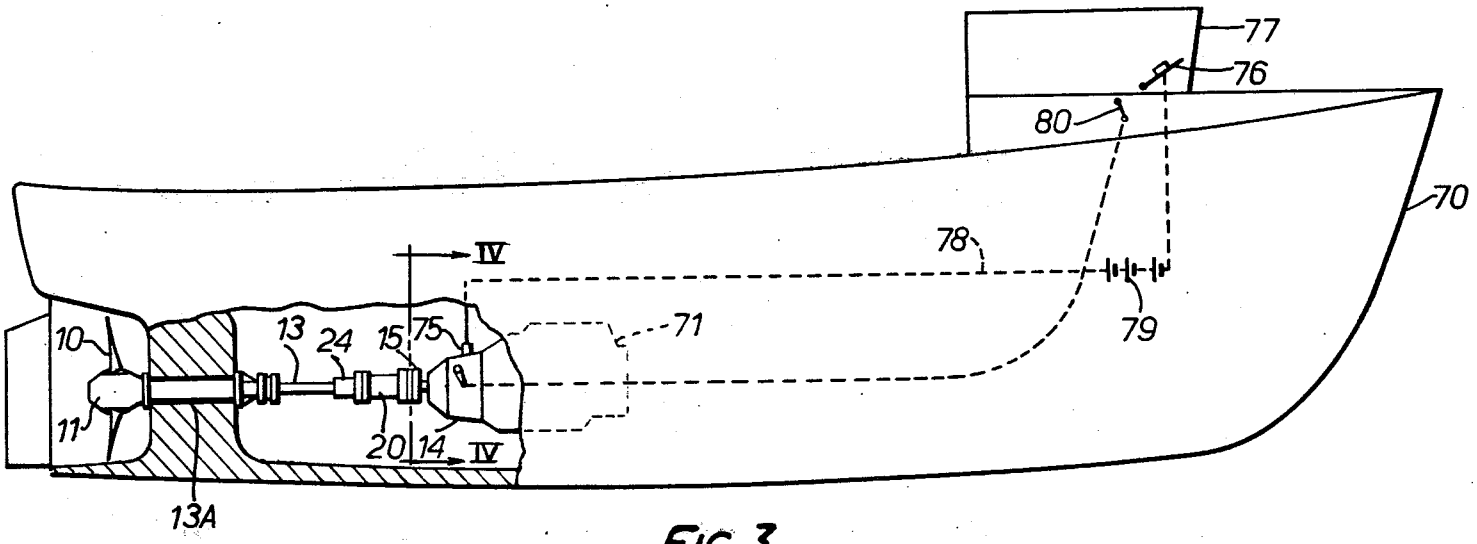
FIG. 3 is a diagram showing in side view the general layout of a vessel having a complete marine propulsion system incorporating the parts shown in FIG. 1, 1A or 1B.

In the arrangement shown in FIG. 1, a ship's propulsion system comprises a variable-pitch screw propeller 10 having a hub 11 and blades 12, a propeller shaft 13 on the outboard end of which the hub 11 is mounted, and a reduction gearbox 14 coupled to the inboard end of the propeller shaft to transmit to it torque derived from an i.c. engine, for example a diesel engine, mounted in the vessel as shown in FIG. 3 and constituting its prime mover. The usual bearings and glanding 13A (see FIG. 3) are provided to support and seal the shaft 13.

The output flange 15 of the gearbox 14 is splined or keyed onto the output shaft 16 of the gearbox, and is secured by means of a nut 17. The output flange 15 is secured by bolts 18 to a spacing disc 15A, which in turn is secured by bolts 18A to the flange 19 of an actuator housing 20. The other end of the actuator housing 20 has a flange 21 which is secured by bolts 22 to the flange 23 of a tubular half-coupling 24, the latter being keyed to the propeller shaft 13 by means of a key 25 and secured thereon by means of a nut 26. A spacing disc 27 is interposed between the housing 20 and the half-coupling 24. The actuator housing 20 comprises a capsule having a cylindrical bore 28 which forms the cylinder of a hydraulic actuator 30 whose piston 31 is secured onto the end of a piston rod 32 by means of a nut 33. The piston 31 carries sealing rings 34, 35 which seal it for longitudinal sliding movement in the cylinder 28. Pressure oil can be supplied to the cylinder 28 on the right-hand side of the piston 31 (as seen in the drawing) through a coaxial passage 36 formed in the output shaft 16 of the gearbox. This pressure oil supply is derived from the oil pump which is mounted in the inerior of the gearbox, and is controlled by an associated control valve, as will be described.

A return spring 38 in the form of a stack of conical disc springs is located in the cylinder 28 on the left-hand side of the piston 31 and acts between the piston and an annular abutment member 39 positioned in the cylinder 28 to bear against a step 40. The piston 31 has an integral spigot 31A surrounding the piston rod 32 and sliding in the central aperture formed in the annular abutment member 39. The spigot 31A carries an external stop nut 31B at its outer end, which serves to retain the prestressed assembly of piston, abutment member, springs and pins before and during assembly into the housing 20. The return spring 38 biases the piston 31 towards the right in the cylinder 28, and normally holds the piston in a first position abutted against a stop ring 41 in the end of the cylinder nearest to the gearbox. The piston 31 carries a removable annular wear plate 42 which is bolted to it by bolts 43 and engages the stop ring 41. When pressure oil is admitted into the cylinder 28 through the passage 36, it drives the piston 31 towards the left in the drawing, against the force of the return spring 38, until the piston reaches its extreme left-hand position in which it abuts against a stop ring 44 in the end of the cylinder nearest to the propeller shaft 13. When the oil pressure in the right-hand end of the cylinder 28 collapses, however, the return spring 38 drives the piston 31 back to its extreme right-hand position in the cylinder.

Thus axial movement of the actuator piston 31 is transmitted to the piston rod 32 and thence to a pitch control rod 45 which is slidably mounted in a longitudinal bore 47 in the propeller shaft 13 and is secured at its right-hand end to the piston rod 32 by a coupling 46, the piston 31 thus producing longitudinal movement of the pitch control rod 45 in the bore 35 in the propeller shaft 13. At its outer (left-hand) end the rod 45 is coupled to a blade pitch actuating mechanism 48 of the known cam block and trunnion type mounted in the hub 11, whereby the movement of the rod 45 towards the gearbox 14 increases the pitch angle of the propeller blades 12 and vice versa. The mechanism 48 comprises a pin-holder sleeve 49 secured to the pitch control rod 45 and carrying a set of three driving pins 50 which respectively engage in cam slots 51 formed in three cam blocks 52 which are secured to the trunnion shafts 53 of the three screw blades 12 journalled in bearings 54 in the hub 11. Thus longitudinal movement of the pitch control rod 45 causes the pins 50 to rotate the cam blocks 52 by their engagement in the cam grooves 51 therein and hence to alter the blade pitch angle of the three blades 12.

Thus the arrangement described and illustrated provides for two distinct predetermined settings of the propeller pitch, namely a coarse-pitch setting suitable for normal free running, which setting is achieved by the return spring 38 moving the piston 31 into its extreme right-hand position in FIG. 1; and a fine-pitch setting suitable for towing, trawling or other conditions of increased propulsive thrust and/or lower speed, which setting is achieved by the operation of the hydraulic actuator 30 by means of its associated control valve, to move the piston 31 into its extreme left-hand position. Either of these two pitch settings can be selected from the conning position of the vessel, by operation of a manual control coupled to the control valve of the actuator, which valve may be of the electro-hydraulic type incorporating a solenoid. The arrangement thus enables the r.p.m. of the diesel or other propulsion engine to be maintained at the same predetermined optimum value under towing conditions as well as under conditions of free running, simply by the selection of the appropriate predetermined pitch setting. When astern drive of the vessel is required, this is provided by selection of the reverse gear in the gearbox 14 by means of the astern clutch provided therein, thereby reversing the direction of rotation of the propeller shaft and screw without altering the blade pitch.

The arrangement described and illustrated is simple and quick to install, and can be used in conjunction with any suitable standard reversing reduction gearbox, which can readily be modified to provide the small pressure oil feed required by the hydraulic actuator 30.

The exact coarse and fine pitch settings are determined by the thickness of the two stop rings 41 and 44, and fine tuning of the pitch settings can easily be effected by the selection and fitting of stop rings of appropriate thickness.

This feature enables the pitch settings to be adjusted after free-running and bollard pull trials have been carried out following the fitting of the equipment into the vessel. This feature also enables gearboxes of different ratios to be used, the two blade pitch settings being appropriately adjusted to suit the gearbox ratio in use. Thus in the event of a gearbox failure, a replacement gearbox of a different ratio may be used if a box of the same ratio as the failed box is not immediately available.

In the event of a failure of the oil pressure supply to the actuator 30, or of its control system, the return spring 38 will return the blades to the coarse-pitch setting suitable for normal free running i.e. a fail-safe arrangement.

Figure 1A:
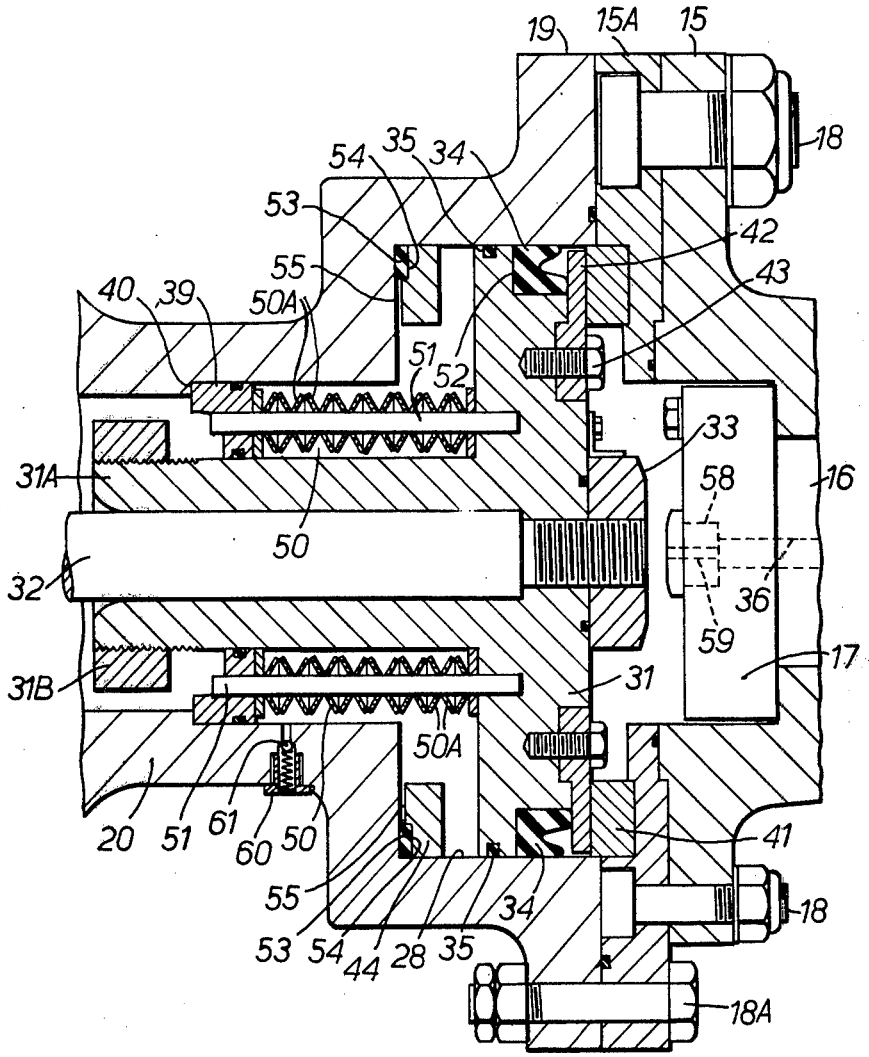
FIG. 1A is a fragmentary sectional view of part of the actuator cylinder and the gearbox flange in a modification of the embodiment of FIG. 1 employing a cluster of stacks of small disc springs as the biasing means.

Whilst in FIG. 1 the return spring 38 is shown as being a single stack of conical disc springs, it may be preferred to use instead a cluster of stacks 50 of smaller-diameter conical disc springs as shown in FIG. 1A, each spring 50A being threaded over and guided by a pin 51 which is rigidly mounted at one end in a bore in the actuator piston 31 and at its other end slides in an aperture formed in the abutment member 39. The pins 51 and their associated spring stacks 50 are distributed circumferentially around the piston 31 at equal spacings, and the springs 50A are of equal sizes and rates producing a powerful return thrust on the piston for a very short travel of the piston and a very short compression of the springs. Moreover the return spring or springs 38 or 50A may be assisted by an additional spring or springs housed in the propeller hub 11 and acting on the pitch control rod 45. Again, in heavier-duty installations the spring return systems referred to may be replaced by any form of hydraulic or pneumatic buffering system capable of being prestressed to provide the required return thrust to return the blades to the normal coarse pitch position.

In each of the arrangements of FIGS. 1 and 1A, the actuator piston 31 carries a main resilient sealing ring 34 which is retained in a circumferential step 52 in the piston periphery by means of the annular wear plate 42. The piston also carries a smaller auxiliary sealing ring 35 in a groove in its circumference. The rear stop ring 44 is stepped circumferentially at its rear face and a resilient ring 53 is trapped in this step 54, as best illustrated in FIG. 1A.

The axial thickness of the ring 53 in its uncompressed state is greater than the axial depth of the step 54, so that so long as the ring 53 remains uncompressed it maintains a small clearance 55 between the rear face of the stop ring and the body of the actuator housing 20. However when the piston 31 bears against the stop ring 44 under the pressure of hydraulic fluid admitted into the right-hand end (as seen in FIGS. 1 or 1A) of the actuator cylinder 28, so that the travel of the piston is limited by the stop ring 44, the hydraulic pressure acting on the piston 31 will compress the ring 53 both axially and radially, since the ring is contained between radial and cylindrical surfaces. This compression will produce a tight sealing action between the ring 53 and the adjacent faces of the stop ring and of the cylinder, and will prevent leakage past the ring 53 of any hydraulic fluid which may have leaked past the seals 34 and 35. Leakage between the piston 31 and the stop ring 44 is prevented by the abutment under pressure of their matching radial metal faces.

Moreover it will be appreciated that since the entire thrust of the hydraulic fluid on the forward face of the piston is available to act on the much smaller area of the end face of the resilient ring 53, it will produce an internal compressive stress in the material of the ring 53 which is correspondingly greater than the hydraulic pressure in the cylinder 28. Hence the highly-compressed ring 53 will act as a pressure accumulator or pressure intensifier, which reacts through the piston onto the hydraulic fluid in the right hand end of the cylinder 28, and maintains the level of the pressure therein.

It will be seen that a plug 58 is screwed into the face of the securing nut 17 on the gearbox output shaft 16, this plug having an axial bore 59 whose diameter is smaller than that of the oil passage 36. The plug 58 acts as a throttling member which reduces the rate of flow of pressure oil into the cylinder of the actuator 30, and of return oil from the cylinder by the springs 38 or 50, and hence reduces the rate of change of blade pitch angle by the actuator when it is operated, and by the springs when the actuator is subsequently de-energised. The rate of pitch change can be adjusted by exchanging the plug 58 for another having a bore 59 of a different diameter.

A vent plug 60 incorporating a spring-loaded non-return ball valve 61 is mounted in the wall of the capsule housing 20 in a position to vent the cylinder 28 on the left-hand side of the head of the piston 31 and prevent the build-up of air pressure behind the piston during the working stroke of the actuator 30. The vent plug 60 also acts as a witness device to indicate any failure of the piston seals 34 and 35. In the event of oil leaking past the seals into the left hand end of the cylinder 28 the subsequent actuation of the actuator will drive oil out through the vent plug 60. Accordingly, as a cockpit check before putting out to sea, the operator would first actuate the actuator several times to make sure that air, and no oil, emerged from the vent plug 60.

If the gearbox 14 is not required to be employed with a pitch control system according to FIG. 1 or FIG. 1A, the plug 58 would be replaced by a blind plug having no drilling 59. Thus a run of production gearboxes could be manufactured complete with the oil passageway 36 and tapped aperture for a plug in the output shaft. Those gearboxes of the production run which were to be used with screw pitch control systems according to FIG. 1 or FIG. 1A would be provided with drilled plugs 58, whilst other gear-boxes of the run which were to be used for other purposes would be provided with blind plugs instead.

Figure 1B:
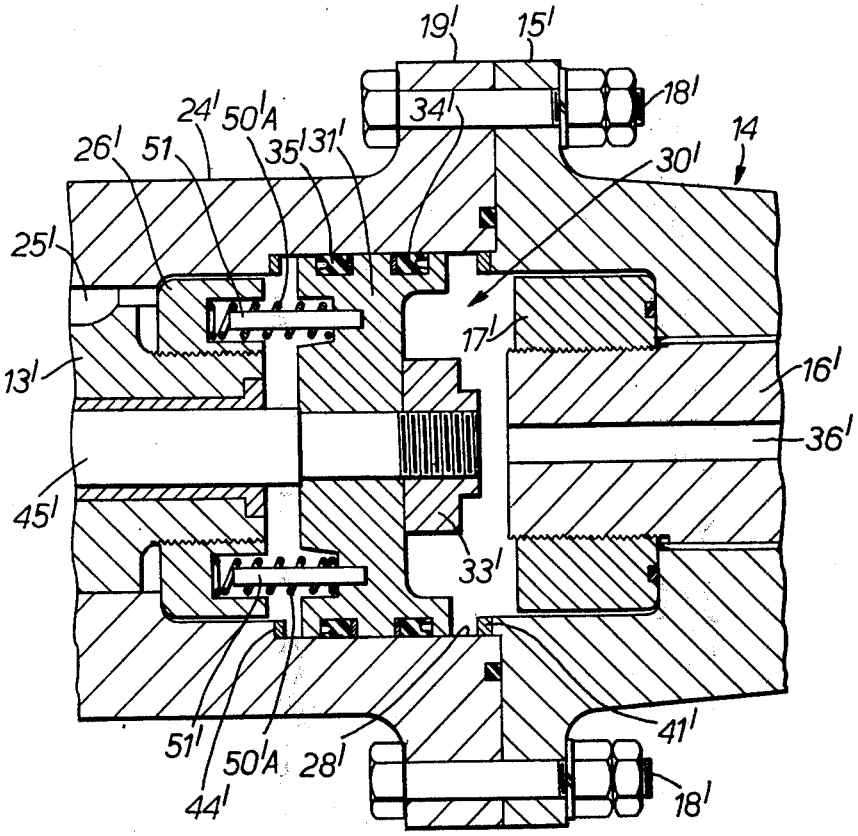
FIG. 1B is a fragmentary view, similar to FIG. 1A, of another modification of the embodiment of FIG. 1.
Figures 1, 2:
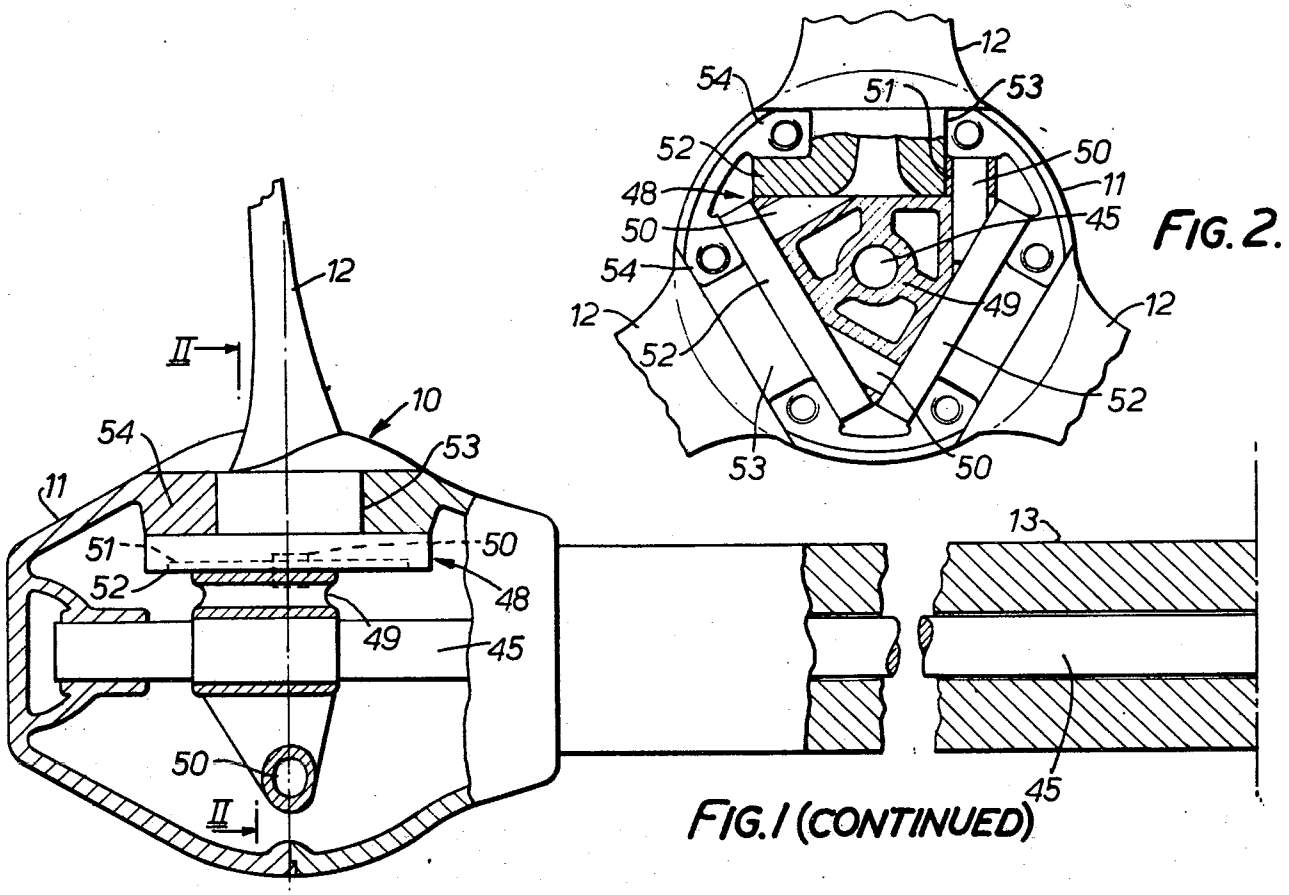
FIG. 2 is a cross-section on the line II—II of FIG. 1, showing the cam-block mechanism for rotating the stub shafts of the screw blades to vary the blade pitch.

FIG. 1B shows a second modification of the arrangement of FIG. 1 in which the hydraulic actuator 30' is housed in the half-coupling 24' instead of in a separate tubular capsule housing 20, and the cylinder 28' is formed in the half-coupling 24'. In FIG. 1B parts which respectively correspond to parts in FIG. 1 or 1A are given the same respective reference numerals qualified by a prime, as 30'.

In the system of FIG. 1B, the return spring assembly comprises a cluster of circumferentially-distributed helical springs 50'A. Each helical spring 50'A is pre-compressed and surrounds a pin 51' and acts between the piston head and the securing nut 26' on the end of the shaft 13'. The piston 31' is in this case mounted directly on the end of the pitch control rod 45' and secured by a nut 33'. The method of functioning of the arrangement of FIG. 1B is generally the same as that of FIG. 1.

Figure 4:
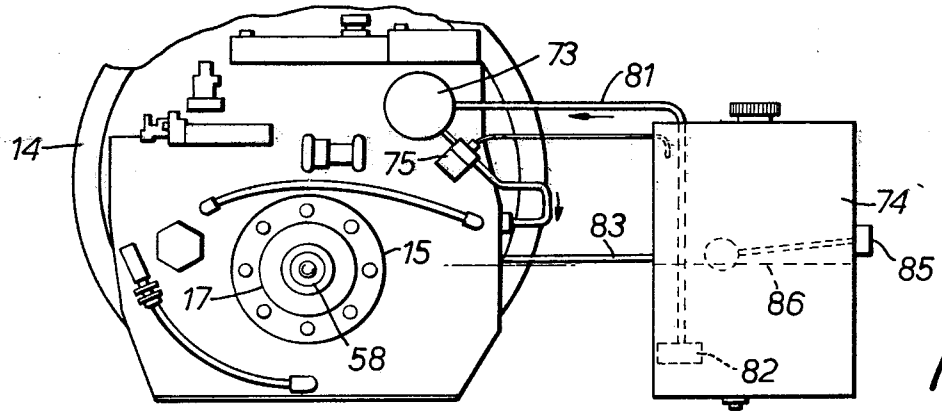
FIG. 4 is a sectional view on the line IV—IV in FIG. 3.

FIGS. 3 and 4 show diagrammatically the equipment of FIG. 1 or FIG. 1A installed in a ship or boat whose hull outline is indicated at 70. A diesel engine 71 or other prime mover is mounted near the stern of the boat and is coupled to the input shaft of the reduction gearbox 14, and the actuator capsule 20 is interposed between the bolted to the output flange 15 of the gearbox and the flange 23 of the half-coupling 24 as already described. The propeller shaft 13 is journalled in a shaft bearing 13A provided with the usual sealing gland, and extends outboard of the hull 70, carrying the screw propeller 10 at its outboard end.

An additional oil pump 73 is provided mounted back-to-back with the oil pump which supplies the pressurised lubrication system of the gearbox 14, the two pumps being driven by a common drive shaft. The pump 73 draws oil from an oil reservoir 74 and delivers it to the longitudinal passage 36 in the gearbox output shaft 16 and thence to the actuator 30. The supply of oil from the pump 73 to the actuator 30 is controlled by an electro-hydraulic valve 75 of solenoid type, which is itself controlled by a manually-operated push-button switch 76 mounted in the conning station or bridge 77 of the ship or boat 70. The switch 76 connects the valve 75 by electric leads 78 to the ship's batteries 79. Thus my manual operation of the switch 76 the helmsman can energise the actuator 30 to select the fine-pitch setting of the screw propeller blades, and by releasing the button of the switch 76 to open the switch he can de-energise the actuator to allow the springs 38 or 50 to return the pitch control rod to its coarse-pitch setting. The helmsman can thus select either of the predetermined coarse-pitch and fine-pitch settings of the screw blades by the switch 76; and can select either forward or reverse propulsion by means of the gear selector lever (shown diagrammatically at 80) of the reduction gearbox, with either the coarse-pitch or the fine-pitch setting of the screw blades selectable by the switch 76 in either case.

The oil reservoir 74 ensures sufficient oil capacity to supply both the gearbox lubrication pump and the additional pump 73 safely. The reservoir 71 is mounted alongside the gearbox 14 and connected to it by a suction pipe 81 and filter 82, and by a balance pipe 83, as shown in FIG. 4.

The reservoir 74 is provided with a float-controlled electrically-operated warning device indicated at 85 which provids an audible or visible warning signal in the event of the oil level in the reservoir and gearbox falling below a predetermined minimum level 86 just below the balance pipe 83.

Figure 5:
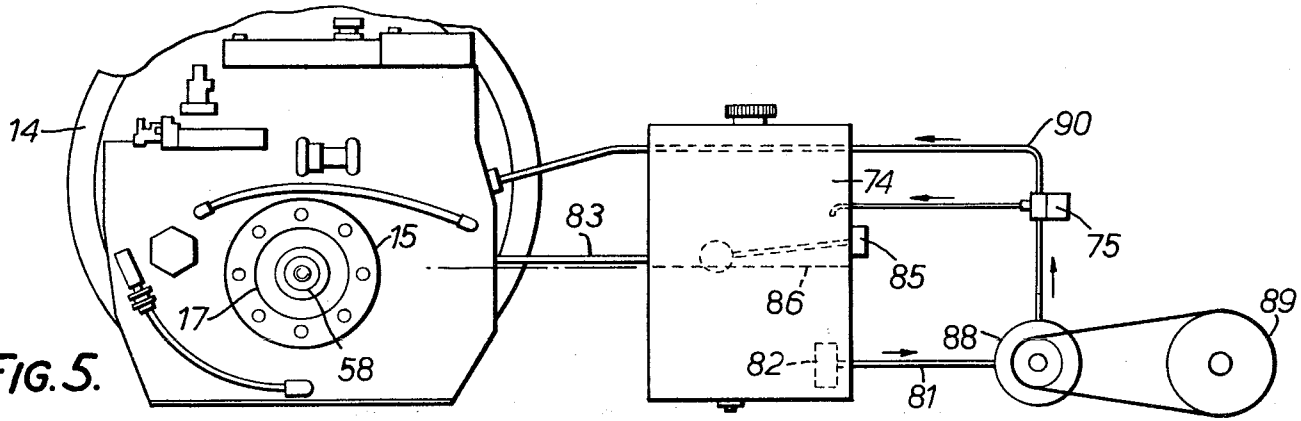
FIGS. 5, 6 and 7 are sectional views similar to FIG. 4 showing three modifications of that arrangement.

FIG. 5 shows an alternative arrangement for the pressure oil supply to the actuator 30, in which in place of the pump 73 on the gearbox 14, a separate pump 88 is mounted outside the gearbox and draws oil from the reservoir through a filter 82 and suction pipe 81. The pump 88 is driven either by a separate electric motor 89, or by a mechanical drive from the prime mover 71, and delivers pressurised oil through a delivery pipe 90 to the longitudinal passage 36 in the gearbox output shaft 16. The solenoid valve 75, which also acts as a pressure relief valve, is connected in the delivery pipe 90.

Figure 6:
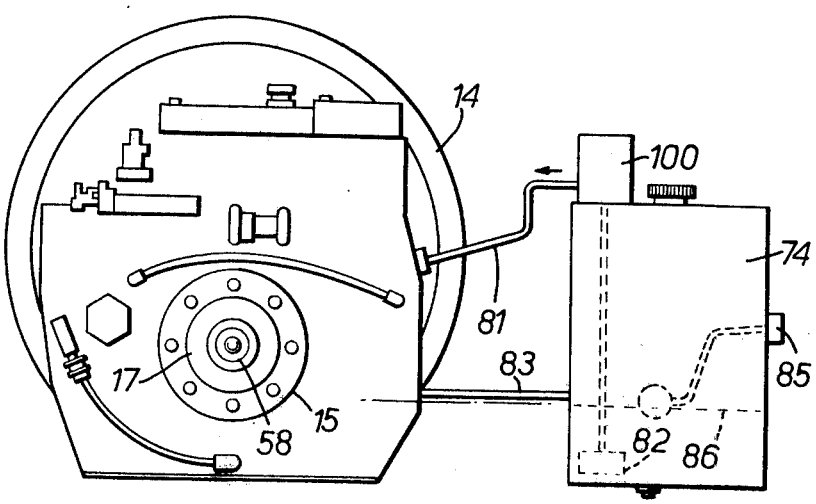

FIG. 6 shows a third arrangement of pump for providing the pressurised oil supply to the actuator 30. In this case an electric pump 100 is mounted on the external reservoir 74 and is directly connected to the push-button switch 76 in the bridge 77 so as to be controlled thereby. The pump 100 draws oil from the reservoir through the pipe 81 and filter 82, and delivers pressurised oil to the passage 36 leading to the actuator 30 through a delivery pipe 81. In this case no solenoid-operated valve 75 is provided since the oil supply to the actuator is directly controlled by the switching on and off of the electrical pump 100.

The advantage of using a separate reservoir 74 for the oil supply to the actuator is that in the event of any oil leak occurring in the actuator itself only the oil in the reservoir will be evacuated, whilst that in the gearbox sump will be retained thereby preserving lubrication of the gearbox and preventing damage thereto. Since the actuator is only pressurised under trawling conditions, loss of the oil in the separate reservoir would not impair the capability of the vessel to be navigated with fixed-pitch propeller blades in their coarse setting.

Figure 7:
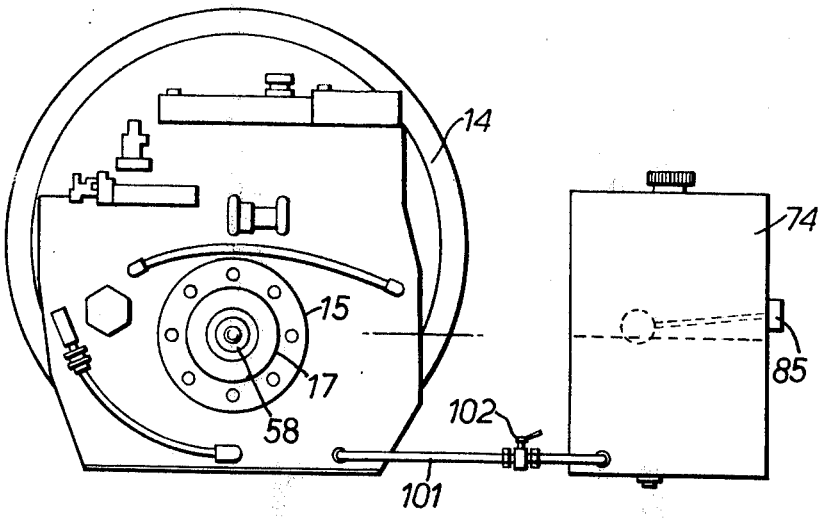

In some cases it may be possible to utilise the integral lubrication pump of the gearbox 14 to supply the pressure oil to the actuator 30 in addition to supplying the pressurised lubrication system of the gearbox. In this case it is advisable to increase the oil capacity of the gearbox 14 by connecting the auxiliary reservoir 74 directly to the sump of the gearbox by means of a connecting pipe 101 provided with a stopcock 102, as shown in FIG. 7.

Figure 8:
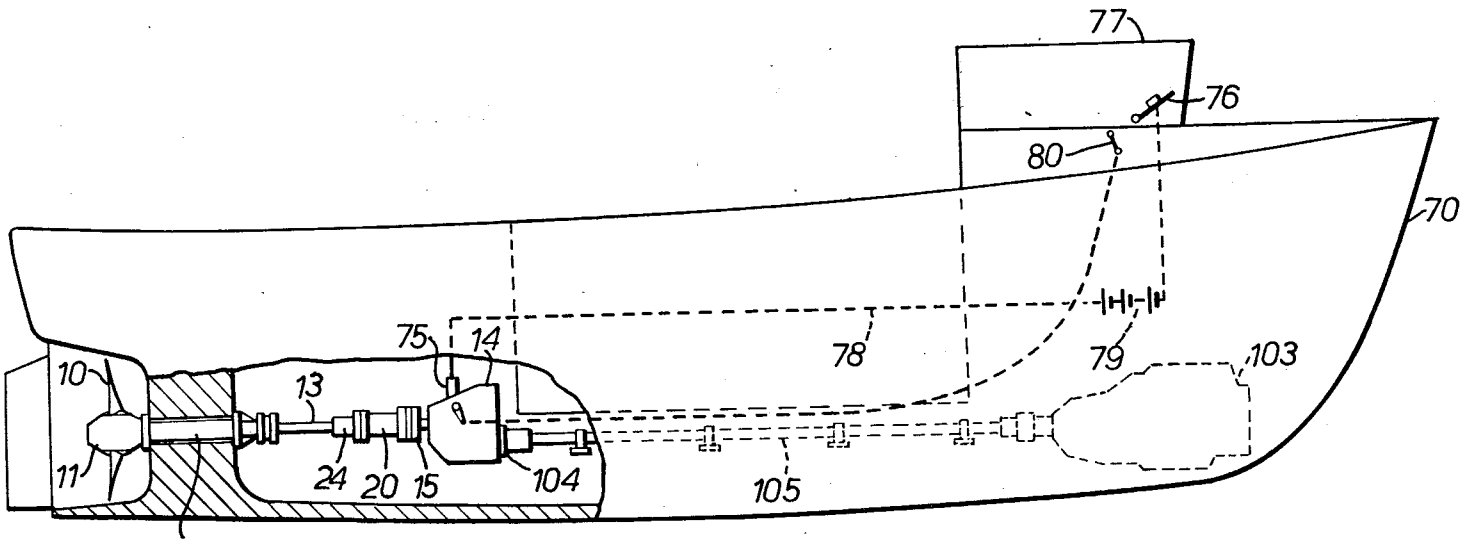
FIG. 8 is a view similar to FIG. 3 showing a vehicle with a forward-mounted engine driving a propulsion system similar to that of FIG. 1, or 1A.

FIG. 8 shows another arrangement for installing the equipment of FIG. 1 or FIG. 1A in a ship or boat 70. In this case the engine 103 which constitutes the prime mover is mounted in the bow portion of the vessel 70 and its crankshaft is connected to the input flange 104 of the gearbox 14 by an intermediate transmission shaft 105. The actuator housing capsule 20 is interposed between the output flange 15 of the gearbox 14 and the propeller shaft coupling 24 as in the embodiment of FIG. 3, and the control arrangements for the actuator 30 are the same as in the embodiment of FIG. 3.

One advantage of the arrangement of FIG. 8 is that the intermediate shaft 105, which transmits power at engine crankshaft speed which is much higher than propeller speed, can be made of much smaller diameter than can the tail shaft 13 which connects the gearbox output flange to the screw propeller. In this way a significant economy in shaft material and fittings can be achieved as compared with arrangements in which the gearbox is forward-mounted directly behind the engine in the bows of the vessel, and is connected to the screw propeller by a low-speed propeller shaft.

What I claim as my invention and desire to secure by Letters Patent is:

1. Marine propulsion apparatus which comprises:

a propeller shaft, a screw propeller operatively coupled to said shaft and having adjustable-pitch blades, a pitch control member operatively coupled to the propeller shaft for adjusting the pitch of the blades, a power-operated actuator coupled to the pitch control member, including means for biasing said pitch control member towards a first setting corresponding to a predetermined forward pitch angle, for moving the pitch control member into a second setting corresponding to a different predetermined pitch angle against the action of the biasing means when the actuator is energized and by virtue of the action of said biasing means for moving the pitch control member back into its said first setting when the actuator is deenergized, and in which:

the actuator comprises a hydraulic piston-and-cylinder mechanism, the piston of the actuator being rigidly mounted on the pitch control member, means being provided for supplying hydraulic pressure fluid to the cylinder of said actuator for acting on one side of said piston to cause it to apply a thrust to the pitch control member, the biasing means comprises spring means acting directly on the opposite side of said piston in opposition to the direction of said thrust, and the said piston-and-cylinder mechanism incorporates stops in opposite ends of the cylinder which when abutted by the piston respectively limit the travel of the piston in end positions in the cylinder corresponding to the said settings of the pitch control member, in combination with:

a speed-reduction transmission having a rotary input shaft for coupling to a prime mover and having a rotary output shaft, and in which the actuator is mounted between the output shaft of the transmission and the adjacent end of the propeller shaft, and the cylinder of the actuator is supplied with pressurised hydraulic fluid delivered through a longitudinal passage formed in said output shaft to act on the said one side of the piston, and in which:

the actuator comprises a tubular coupling member rigidly secured at one end to a coupling flange on said output shaft of the speed reduction transmission, and keyed at its other end to the adjacent end of said propeller shaft, said tubular coupling member being formed with an internal cylinder which constitutes the cylinder of the actuator, and in which the pitch control member comprises a longitudinally movable rod mounted in a longitudinal passage on the propeller shaft, said rod being movable longitudinally in said passage between its said settings, and the piston of the actuator being rigidly secured to the end of said rod nearest to the speed reduction transmission.

2. Marine propulsion apparatus claimed in claim 1 in which the said first setting of the pitch control member corresponds to a first pitch angle suitable for normal free forward running, and the said second setting corresponds to a lesser pitch angle than the first.

3. Marine propulsion apparatus as claimed in claim 2 in which the said second setting of the pitch control member corresponds to a lesser forward pitch angle of the propeller blades than said first pitch angle.

4. Marine propulsion apparatus which comprises:

a propeller shaft, a screw propeller operatively coupled to said shaft and having adjustable-pitch blades, a pitch control member operatively coupled to the propeller shaft for adjusting the pitch of the blades, a power-operated actuator coupled to the pitch control member, including means for biasing said pitch control member towards a first setting corresponding to a predetermined forward pitch angle, for moving the pitch control member into a second setting corresponding to a different predetermined pitch angle against the action of the biasing means when the actuator is energized and by virtue of the action of said biasing means for moving the pitch control member back into its said first setting when the actuator is deenergized, and in which:

the actuator comprises a hydraulic piston-and-cylinder mechanism, the piston of the actuator being rigidly mounted on the pitch control member, means being provided for supplying hydraulic pressure fluid to the cylinder of said actuator for acting on one side of said piston to cause it to apply a thrust to the pitch control member, the biasing means comprises spring means acting directly on the opposite side of said piston in opposition to the direction of said thrust, and the said piston-and-cylinder mechanism incorporates stops in opposite ends of the cylinder which when abutted by the piston respectively limit the travel of the piston in end positions in the cylinder corresponding to the said settings of the pitch control member, in combination with:

a speed-reduction transmission having a rotary input shaft for coupling to a prime mover and having a rotary output shaft, and in which the actuator is mounted between the output shaft of the transmission and the adjacent end of the propeller shaft, and the cylinder of the actuator is supplied with pressurised hydraulic fluid delivered through a longitudinal passage formed in said output shaft to act on the said one side of the piston, and in which:

the actuator comprises a tubular body interposed between the said output shaft of the speed reduction transmission and the said propeller shaft in alignment therewith, said actuator body being rigidly secured at one end to a coupling flange on said output shaft and rigidly secured at its other end to one end of a tubular coupling member, the opposite end of said tubular coupling member being keyed to said adjacent end of the propeller shaft, said tubular body being formed with an internal cylinder which constitutes the cylinder of the actuator, and in which the pitch control member comprises a longitudinally-movable rod mounted in a longitudinal passage in the propeller shaft, said rod being movable longitudinally in said passage between its said settings and the piston of the actuator being rigidly secured to the end of said rod nearest to the speed reduction transmission.

5. Marine propulsion apparatus as claimed in claim 1 in which the speed reduction transmission comprises a gearbox providing alternative forward and reverse drives between its input and its output, and is provided with control means operable to select either forward or reverse drive.

6. Marine propulsion apparatus which comprises:

a propeller shaft, a screw propeller operatively coupled to said shaft and having adjustable-pitch blades, a pitch control member operatively coupled to the propeller shaft for adjusting the pitch of the blades, a power-operated actuator coupled to the pitch control member, including means for biasing said pitch control member towards a first setting corresponding to a predetermined forward pitch angle, for moving the pitch control member into a second setting corresponding to a different predetermined pitch angle against the action of the biasing means when the actuator is energized and by virtue of the action of said biasing means for moving the pitch control member when the actuator is deenergized, and in which:

the actuator comprises a hydraulic piston-and-cylinder mechanism, the piston of the actuator being rigidly mounted on the pitch control member, means being provided for supplying hydraulic pressure fluid to the cylinder of said actuator for acting on one side of said piston to cause it to apply a thrust to the pitch control member, the biasing means comprises spring means acting directly on the opposite side of said piston in opposition to the direction of said thrust, and the said piston-and-cylinder mechanism incorporates stops in opposite ends of the cylinder which when abutted by the piston respectively limit the travel of the piston in end positions in the cylinder corresponding to the said settings of the pitch control member, in combination with:

a speed-reduction transmission having a rotary input shaft for coupling to a prime mover and having a rotary output shaft, and in which the actuator is mounted between the output shaft of the transmission and the adjacent end of the propeller shaft, and the cylinder of the actuator is supplied with pressurised hydraulic fluid delivered through a longitudinal passage formed in said output shaft to act on the said one side of the piston, and in which:

the speed reduction transmission comprises a gearbox providing alternative forward and reverse drives between its input and its output, and control means operable to select either forward or reverse drive, and in which:

the speed-reduction gearbox incorporates an oil reservoir and a pressurised lubrication system including an oil pump, and the said longitudinal passage in the output shaft is connected to the delivery of the oil pump whereby pressurised oil is delivered by the pump to the actuator.

7. Marine propulsion equipment as claimed in claim 6 including remote-controlled valve means connected to control the delivery of pressurised oil from the pump to the actuator.

8. Marine propulsion apparatus which comprises:

a propeller shaft, a screw propeller operatively coupled to said shaft and having adjustable-pitch blades, a pitch control member operatively coupled to the propeller shaft for adjusting the pitch of the blades, a power-operated actuator coupled to the pitch control member, including means for biasing said pitch control member towards a first setting corresponding to a predetermined forward pitch angle, for moving the pitch control member into a second setting corresponding to a different predetermined pitch angle against the action of the biasing means when the actuator is energized and by virtue of the action of said biasing means for moving the pitch control member back into its said first setting when the actuator is deenergized, and in which:

the actuator comprises a hydraulic piston-and-cylinder mechanism, the piston of the actuator being rigidly mounted on the pitch control member, means being provided for supplying hydraulic pressure fluid to the cylinder of said actuator for acting on one side of piston to cause it to apply a thrust to the pitch control member, the biasing means comprises spring means acting directly on the opposite side of said piston in opposition to the direction of said thrust, and the said piston-and-cylinder mechanism incorporates stops in opposite ends of the cylinder which when abutted by the piston respectively limit the travel of the piston in end positions in the cylinder corresponding to the said settings of the pitch control member, in combination with:

a speed-reduction transmission having a rotary input shaft for coupling to a prime mover and having a rotary output shaft, and in which the actuator is mounted between the output shaft of the transmission and the adjacent end of the propeller shaft, and the cylinder of the actuator is supplied with pressurised hydraulic fluid delivered through a longitudinal passage formed in said output shaft to act on the said one side of the piston, and in which:

the speed reduction transmission comprises a gearbox providing alternative forward and reverse drives between its input and its output, and control means operable to select either forward or reverse drive, and in which:

the speed-reduction gearbox incorporates an oil reservoir and an integrated pressurised lubrication system, and which includes an oil pump separate from the integrated lubrication system and arranged to deliver pressurised oil through the said longitudinal passage in the output shaft to the actuator.

9. Marine propulsion apparatus as claimed in claim 8 including remote-controlled means connected to control the delivery of pressurized oil from the pump to the actuator.

10. Marine propulsion apparatus as claimed in claim 9 in which said remote-controlled means comprises a solenoid-operated valve connected in the delivery line of said separate pump, and a switch controlling the solenoid-operated valve.

11. Marine propulsion apparatus as claimed in claim 9 in which the said separate pump is an electrically-driven pump, and in which said remote-controlled means comprises a switch connected to the pump to control its electrical energisation.

12. Marine propulsion apparatus comprising a screw propeller having blades adjustable to either of two predetermined pitch angles which are respectively fine and coarse pitch angles and which are both on the same side of neutral blade pitch, a pitch control member operatively coupled to said propeller for changing the pitch of said blades, two-position-only actuator means coupled to said pitch control member, including means for biasing said control member to a first predetermined position to effect said predetermined coarse pitch propeller angle, for moving said pitch control member into a second predetermined position against said biasing means to effect said predetermined fine pitch propeller angle when said actuator means is energized and for thrusting said pitch control member back into its said first predetermined position when said actuator means is de-energized, and power means for energizing and de-energizing said actuator means as aforesaid, said actuator means comprising a hydraulically sealed movable piston operatively coupled to said pitch control member and having first and second opposite faces, said biasing means being compression spring means operative on said first face for thrusting said piston to a first predetermined setting corresponding to said first predetermined position of said pitch control member, said power means including reversible speed-reduction power transmission means operatively coupled to said actuator means for supplying hydraulic fluid under predetermined pressure through said transmission means and against said second piston face to move said piston against said compression spring means to a second predetermined setting corresponding to said second predetermined position of said pitch control member only while said fluid is supplied under said pressure and for changing the propulsion direction effected by said propeller while the propeller remains in the instant one of its said two predetermined pitch angles.

13. Apparatus as in claim 12 including piston stop means for predetermining at least one of said piston positions.

14. Apparatus as in claim 12 including first and second piston stop means for predetermining said first and second piston positions respectively.

15. Apparatus as in claim 12 wherein said actuator means includes a piston rod extending from said first piston face and coupled to said pitch control member and wherein said compression spring means comprises at least one stack of a multiplicity of contiguous substantially dished disc springs disposed successively in opposition to each other and about said piston rod.

16. Apparatus as in claim 15 wherein there is just one stack of said disc springs with each spring having a central aperture through which said piston rod extends.

17. Apparatus as in claim 15 wherein said spring means comprises a plurality of said stacks of disc springs with said stacks being disposed at equal angular positions around said piston rod on respective axes equidistant from said piston rod.

18. Apparatus as in claim 12 wherein said transmission means has output shaft means containing a passageway for conveying said fluid to said second piston face.

19. Apparatus as in claim 18 including means in said passageway for regulating the rate of piston movement caused by said predetermined fluid pressure.

20. Apparatus as in claim 18 in which said power transmission means incorporates an oil reservoir and a pressurised lubrication system including an oil pump, and in which said passageway in said output shaft means is connected to the delivery of the oil pump for supplying oil as said fluid under predetermined pressure against said second piston face as aforesaid.

21. Apparatus as in claim 20 including remote-controlled valve means connected to control the delivery of pressurised oil from the pump to said second piston face.

22. Apparatus as in claim 18 wherein said transmission incorporates an oil reservoir and an integrated pressurised lubrication system, and an oil pump separate from the integrated pressurised lubrication system connected to deliver pressurised oil as said fluid through said passageway.

23. Apparatus as in claim 22 including remote-controlled means connected to control the delivery of pressurised oil from the pump to the second piston face as aforesaid.

24. Apparatus as in claim 23 in which said remote-controlled means comprises a solenoid-operated valve connected in the delivery line of said separate pump, and a switch controlling the solenoid-operated valve.

25. Apparatus as in claim 23 in which the said separate pump is an electrically driven pump, and in which said remote-controlled means comprises a switch connected to the pump to control its electrical energisation.

26. A hydraulically operated two-position-only actuator for use in marine propulsion apparatus having a screw propeller with blades adjustable to either of two predetermined pitch angles which are respectively fine and coarse pitch angles and which are both on the same side of neutral blade pitch, said actuator comprising a hydraulically sealed movable piston having first and second faces, a piston rod secured to and extending from said first face in a first direction and being adapted for coupling to said propeller, compression spring means disposed about said piston rod and operative on said first face for thrusting said piston to a predetermined limit in a second direction opposite to said first direction, and power means disposed adjacent the second face of said piston and including reversible speed-reduction power transmission means having output shaft means containing a fluid passageway for supplying hydraulic fluid under predetermined pressure against said second piston face to move said piston against said compression spring means in said first direction to another predetermined limit, said limits correspondingly respectively to said coarse and fine propeller pitch angles whereby the propeller propulsion direction can be changed by said reversible transmission without changing its pitch.

27. An actuator as in claim 26 wherein said spring means comprises at least one stack of a multiplicity of contiguous substantially dished disc springs disposed successively in opposition to each other and about said piston rod.

28. An actuator as in claim 27 wherein there is just one stack of said disc springs with each spring having a central aperture through which said piston rod extends.

29. An actuator as in claim 27 wherein said spring means comprises a plurality of disc springs with said stacks being disposed substantially equal angular positions around said piston rod on respective axes equidistant from said piston rod.

30. An actuator as in claim 26 wherein said transmission incorporates an oil reservoir and a pressurised lubrication system including an oil pump, and wherein said passageway in said output shaft means is connected to the delivery of the oil pump for supplying oil as said fluid under predetermined pressure to said second piston face.

31. An actuator as in claim 30 including remote-controlled valve means connected to control the delivery of pressurised oil from the pump to said second piston face.

32. An actuator as in claim 26 wherein said transmission incorporates an oil reservoir and an integrated pressurised lubrication system, and which includes an oil pump separate from the integrated pressurised lubrication system and arranged to deliver pressurised oil as said fluid through said passageway.

33. An actuator as in claim 32 including remote-controlled means connected to control the delivery of pressurised oil from the pump to said second piston face.

34. An actuator as in claim 33 in which said remote-controlled means comprises a solenoid-operated valve connected in the delivery line of said separate pump, and a switch controlling the solenoid-operated valve.

35. An actuator as in claim 33 in which the said separate pump is an electrically driven pump, and in which said remote-controlled means comprises a switch connected to the pump to control its electrical energisation.

36. An actuator as in claim 26 including means in said passageway for regulating the rate of piston movement caused by said predetermined fluid pressure.

37. A hydraulically operable actuator for use with marine propulsion apparatus to control the longitudinal position of a pitch control propeller shaft between two predetermined positions which in turn causes the propeller blades to have a first or second predetermined pitch, comprising:

a housing having a bore extending in the axial direction of said housing, a piston having first and second opposite faces and a periphery substantially hydraulically sealed to said bore for axial movement in said bore in first and second opposite directions, a piston rod secured to said piston and extending from said first face axially in said first direction and being adjusted for coupling to said pitch control propeller shaft, and compression spring means disposed about said piston rod with one end being held against said first face of said piston and the other end being held in said bore at a predetermined point remote from said first face in said first direction for thrusting said piston in said second direction to a predetermined position, said compression spring means comprising at least one stack a of multiplicity of contiguous substantially dished disc springs disposed successively in opposition to each other.

38. An actuator as in claim 37 wherein there is just one stack of said disc springs with each spring having a central aperture through which said piston rod extends in said first direction.

39. An actuator as in claim 37 wherein said spring means comprises a plurality of said stacks of disc springs with said stacks being disposed at equal angular positions around said piston rod on respective axes equidistant from said piston rod.

40. An actuator as in claim 37 including stop means for limiting the movement of said piston in said second direction.

41. An actuator as in claim 40 wherein said stop means is disposed for abutment by said second piston face.

42. An actuator as in claim 37 including stop means for limiting the movement of said piston in said first direction.

43. An actuator as in claim 42 wherein said stop means is securely disposed in said bore at a predetermined position to limit the movement of said piston in said first direction upon abutment by said first face.

44. An actuator as in claim 37 including first stop means for limiting the movement of said piston in said first direction and second stop means for limiting said piston in said second direction.

45. An actuator as in claim 37 including an abutment holding said spring means at said other end and effecting a fluid tight chamber in said bore between said piston and abutment, and a vent plug normally closing the exterior of an aperture through said housing at a location between said abutment and first face of said piston for venting said chamber when said piston is moved in said first direction.

46. An actuator as in claim 45 including first stop means for limiting movement of said piston in said first direction and second stop means for limiting movement of said piston in said second direction.

47. An actuator as in claim 46 wherein said bore includes a shoulder in said chamber and said first stop means includes a stop ring adjacent said shoulder, there being between said shoulder and stop ring a resilient ring which becomes highly compressed both radially and axially, when said second piston face abuts said stop ring and which then reacts through the stop ring and piston against any force impending on the second piston face.

48. An actuator as in claim 37 and further including means for supplying pressurised hydraulic fluid to the said second piston face to drive said piston in said first direction a predetermined distance against the force of said spring means.

49. An actuator as in claim 48 including a reduction gear box secured to said housing at a second piston face end thereof and forming a fluid tight chamber therewith, said gear box having output shaft means containing a passageway for conveying said fluid into said chamber.

50. An actuator as in claim 49 including means in said passageway for regulating the rate of first direction piston movement caused by said pressurised fluid.

51. An actuator as in claim 49 including in said output shaft means a plug having a throughput aperture communicating with said passageway and being of predetermined size for regulating the rate of first direction piston movement caused by said fluid.

52. An actuator as in claim 49 wherein said gear box is of the reversible type for causing forward or reverse rotation of said output shaft means.

53. An actuator as in claim 52 in which said gear box incorporates an oil reservoir and a pressurised lubrication system including an oil pump, and in which said passageway in the output shaft means is connected to the delivery of the oil pump for supplying oil as said pressurised fluid to said second piston face.

54. An actuator as in claim 53 including remote-controlled valve means connected to control the delivery of pressurised oil from the pump to said second piston face.

55. An actuator as in claim 52 wherein said gear box incorporates an oil reservoir and an integrated pressurised lubrication system, and an oil pump separate from the integrated pressurised lubication system connected to deliver pressurised oil as said fluid through said passageway.

56. Apparatus as in claim 55 including remote-controlled means connected to control the delivery of pressurised oil from the pump to said second piston face.

57. Apparatus as in claim 56 in which said remote-controlled means comprises a solenoid-operated valve connected in the delivery line of said separate pump, and a switch controlling the solenoid-operated valve.

58. Apparatus as in claim 56 in which the said separate pump is an electrically driven pump, and in which said remote-controlled means comprises a switch connected to the pump to control its electrical energisation.

* * * * *